US006200001B1

(12) United States Patent
Tin Shun Victor

(10) Patent No.: US 6,200,001 B1
(45) Date of Patent: Mar. 13, 2001

(54) SWIVEL NIGHTLIGHT

(75) Inventor: Au Yeung Tin Shun Victor, Hong Kong (CN)

(73) Assignee: Regent Lighting Corporation, Burlington, NC (US)

( * ) Notice: Subject to any disclaimer, the term of this patent is extended or adjusted under 35 U.S.C. 154(b) by 0 days.

(21) Appl. No.: 09/007,597

(22) Filed: Jan. 15, 1998

(51) Int. Cl.[7] ..... H01R 33/00

(52) U.S. Cl. ..... 362/226; 362/282; 362/322; 362/226; 362/319; 362/187

(58) Field of Search ..... 362/385, 226, 362/183, 282, 277, 187, 322, 319

(56) References Cited

U.S. PATENT DOCUMENTS

| | | | | |
|---|---|---|---|---|
| D. 210,683 | | 4/1968 | Tyler . | |
| D. 258,914 | | 4/1981 | Chamot . | |
| D. 270,095 | | 8/1983 | Palmer . | |
| D. 378,617 | | 3/1997 | Yuen . | |
| 1,434,302 | | 10/1922 | Marcotte . | |
| 1,505,654 | | 8/1924 | Macbeth . | |
| 1,670,572 | | 5/1928 | Hotchkin . | |
| 2,075,364 | | 3/1937 | Smith . | |
| 3,061,716 | | 10/1962 | Benander . | |
| 3,203,126 | | 8/1965 | Eliot . | |
| 3,248,530 | | 4/1966 | Titmas . | |
| 3,443,083 | | 5/1969 | Curran . | |
| 3,706,004 | | 12/1972 | Schwartz . | |
| 3,968,355 | * | 7/1976 | Smallegan | 362/226 |
| 4,343,032 | | 8/1982 | Schwartz . | |
| 4,388,673 | * | 6/1983 | Maglica | 362/183 |
| 4,527,224 | | 7/1985 | Sangiamo et al. . | |
| 4,533,982 | | 8/1985 | Kozar . | |
| 4,549,250 | | 10/1985 | Spector . | |
| 4,611,266 | | 9/1986 | Schwartz . | |
| 4,654,764 | | 3/1987 | Hsiao . | |
| 4,714,984 | | 12/1987 | Spector . | |
| 5,339,231 | * | 8/1994 | Parsalano et al. | 362/226 |
| 5,412,550 | | 5/1995 | Hsieh et al. . | |
| 5,420,764 | | 5/1995 | Hussain et al. . | |
| 5,523,932 | | 6/1996 | Bogdanovs . | |
| 5,544,025 | | 8/1996 | Bohlool et al. . | |
| 5,556,192 | | 9/1996 | Wang . | |
| 5,599,091 | | 2/1997 | Kira . | |
| 5,683,176 | * | 11/1997 | Clendenin | 362/385 |

* cited by examiner

*Primary Examiner*—Sandra O'Shea
*Assistant Examiner*—Bertrude Zeade
(74) *Attorney, Agent, or Firm*—Niro, Scavone, Haller & Niro

(57) ABSTRACT

A night light which plugs directly into an electrical outlet with a rotatable housing which swivels 360° to direct light in a desired direction. The night light includes a light bulb connected to its power source in a self-contained housing. The night light also includes a light sensor which activates and deactivates the bulb depending upon ambient light levels.

5 Claims, 1 Drawing Sheet

SWIVEL NIGHTLIGHT

FIELD OF INVENTION

This invention relates to the field of lamps providing low level illumination as night lights.

BACKGROUND OF THE INVENTION

Night lights which provide low-level illumination are commonly found where illumination is sought, but only needed in a limited or subdued amount. Traditionally, most standard night lights consist of a bulb or reflector which casts the light in an unfocused way and to a widespread area. As well, the orientation of such night lights is affected by the availability of either a horizontal or vertical electric socket.

The present invention relates to a night light which allows its light to be focused in a specific direction, can be plugged into either horizontally or vertically oriented electric sockets; and possesses a light sensor for automatic activation or deactivation.

SUMMARY OF THE INVENTION

The invention involves a night light which can be swivelled. The night light includes a lens in a housing which rotates up to 360° to allow a focusing of illumination. The night light also has a bulb and power source inside one self-contained housing, and can be plugged directly into an electric socket. The night light possesses a light sensor that is also connected to the power source which activates or deactivates the bulb according to the level of ambient light. The night light herein disclosed, provides improved illumination by directing light where desired, and improved functionality through its activation/deactivation ability as well as its ease of use as compared to current night lights.

BRIEF DESCRIPTION OF THE DRAWINGS other features and benefits of the invention can be more clearly understood with reference to the specification and the accompanying drawings in which.

DESCRIPTION OF THE PREFERRED EMBODIMENT

Figure 1:
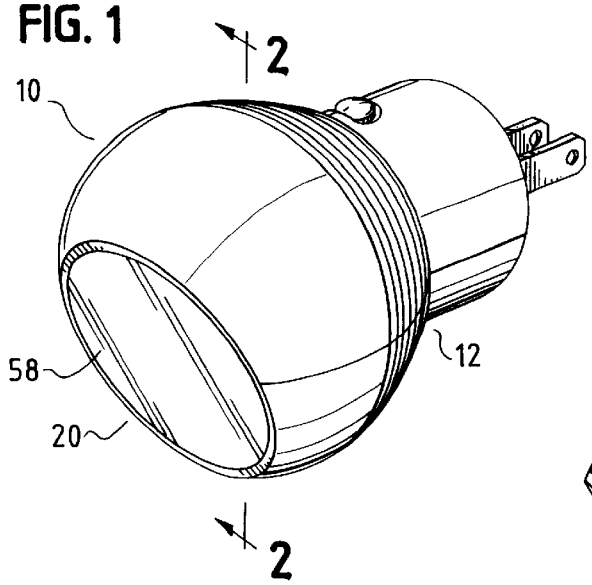
FIG. 1 is a perspective view of an embodiment of the invention.
Figure 2:
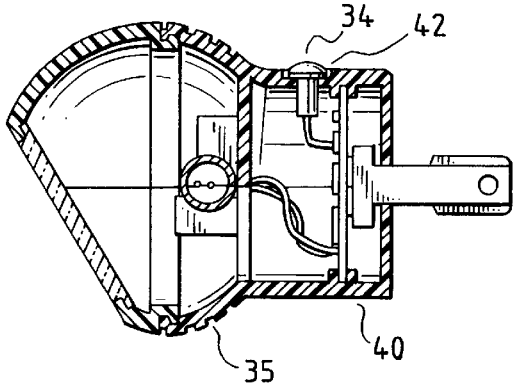
FIG. 2 is a side view of the embodiment of the invention shown in FIG. 1 displaying the internal connections of the invention.
Figure 3:
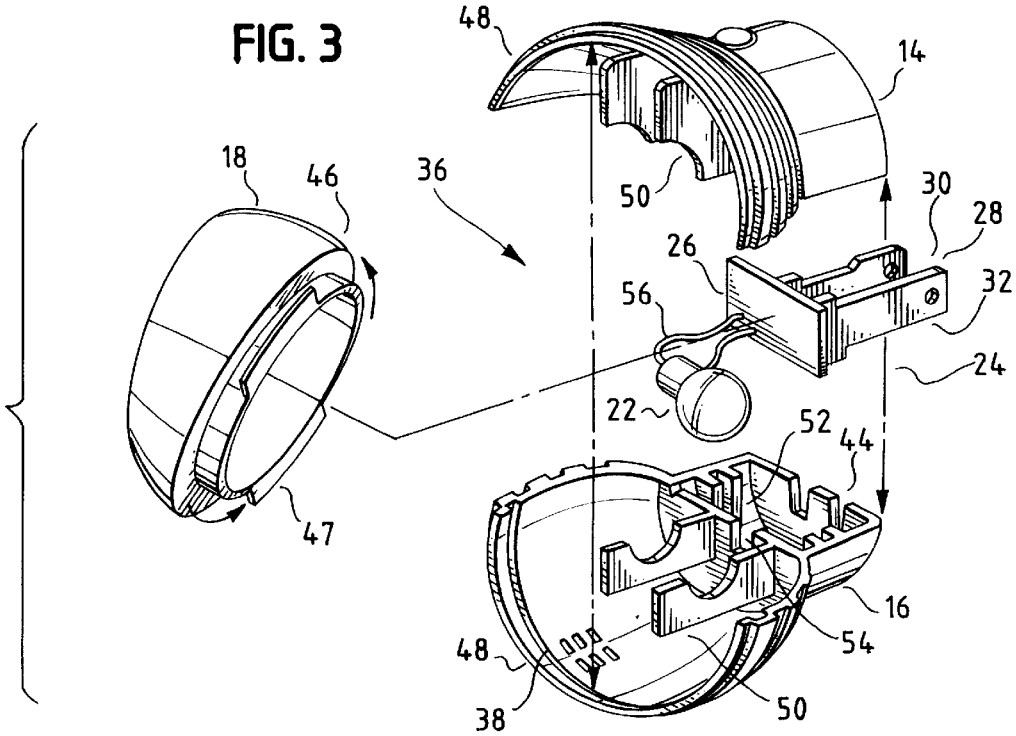
FIG. 3 is an exploded view of the embodiment of the invention shown in FIG. 1.

An embodiment of a swivel night light 10 shown in FIGS. 1, 2, and 3, includes a housing unit 12 comprising a first housing 14, a second housing 16, and a rotatable head 18. Head 18 contains a lens 20. The first housing 14 and second housing 16 connect to enclose a light bulb 22, and a power source 24 for the night light 10. The power source 24 includes a PCB board 26 connected to a D.C. positive contact 28 and a D.C. negative contact 30 in the form of a plug 32. A light sensor 34, seated in housing unit 12, is also connected to the PCB board 26, as is the light bulb 22.

The head 18 is rotatably connected to housing unit 12 so that head 18 may be rotated or swivelled 360° allowing lens 20 to be aimed in multiple desired directions. The rotatability of the head 18 and lens 20 also allows the plug 32 to be connected to either vertically or horizontally oriented electrical outlets without affecting the cast light.

The housing unit 12 is generally rounded in shape. It possesses a series of three ridges 35 which run the circumference of the open end 36 of the housing unit 12. The ridges 35 encompass ventilation slots 38 which allow the release of heat generated by the operation of the light bulb 22, as well as provide the admittance of a cooling air flow. The stem like closed section 40 of the housing unit 12 possesses an opening 42 to seat the light sensor 34 as well as openings 44 through which the prongs 28 and 30 of plug 32 extend.

Head 18 possesses two outwardly extending flanges 46 and 47 which, when seated within the annular ring 48 found within the open end 36 of the housing unit 12, serves as the connection of the head 18 to the housing unit 12. The connection of the head 18 to the housing unit 12 by flanges 46 and 47 and annular notched ring 48 allows head 18 to rotate relative to the housing unit 12. Of course, head 18 may include the annular ring or groove and housing 12 may include the extended flanges.

The light bulb 22 is secured within the housing unit 12 by a clamp-like holder 50. The holder 50 also serves as a barrier, separating the light bulb 22 from the stem portion 40 of the housing unit 12. Within the stem portion 40, the PCB board 26 is secured by clamps 52. A slot 54 in holder 50 allows for wires 56 to pass through and connect the light bulb 22 with the PCB board 26.

The Lens 20 possesses parallel ridges 58 which reflect and recast the light provided by the light bulb 22.

In use, the light 10 is first plugged into an electrical outlet. Then, through use of the rotatable head 18, the lens is directed at the object or area to be illuminated. Since head 18 may rotate 360°, illumination of an object or surface can be directed as desired independent of how the light is actually plugged into an electrical outlet.

These and other examples of the concept of the invention illustrated above are intended by way of example and the actual scope of the invention is to be determined solely from the following claims.

What is claimed is:

1. A night light comprising:

a housing defining an internal cavity in which a light source is located;

a rotatable head having a lens affixed to said housing, said light source positioned to emit light through said lens and the rotation of said head and lens allows for the direction of light emitted through said lens to be adjusted by said rotation; and a power and circuit means located within said housing which activates and deactivates said light bulb in response to external levels of light.

2. The night light of claim 1 where said housing comprises a first housing and a second housing which matingly connect together.

3. The night light of claim 2 wherein said rotatable head includes at least one outwardly extending flange, said outwardly extending flange seats within an annular groove of said housing which allows said rotatable head to rotate in relation to said housing.

4. The night light of claim 3 wherein said rotatable head includes an annular groove and said housing includes at least one extended flange which seats in said groove which allows said head to rotate in relation to said housing.

5. The night light of claim 1 wherein said lens is angled.

* * * * *